US006250889B1

(12) United States Patent
Shepard

(10) Patent No.: US 6,250,889 B1
(45) Date of Patent: Jun. 26, 2001

(54) PUMP WITH IMPROVED PRIMING

(75) Inventor: John P. C. Shepard, Gloucestershire (GB)

(73) Assignee: Godwin Pumps Limited (GB)

( * ) Notice: Subject to any disclaimer, the term of this patent is extended or adjusted under 35 U.S.C. 154(b) by 0 days.

(21) Appl. No.: 09/490,092

(22) Filed: Jan. 24, 2000

(30) Foreign Application Priority Data

Jan. 26, 1999 (GB) ..... 9901547

(51) Int. Cl.[7] ..... F04B 23/08
(52) U.S. Cl. ..... 417/89
(58) Field of Search ..... 417/89, 76, 84, 417/88, 199.2, 201

(56) References Cited

U.S. PATENT DOCUMENTS

| | | | | |
|---|---|---|---|---|
| 1,551,362 | | 8/1925 | Barton . | |
| 5,536,147 | * | 7/1996 | Lang | 417/199.2 |
| 5,772,394 | * | 6/1998 | Yokota | 415/56.1 |
| 6,152,689 | * | 11/2000 | Yokota | 415/56.1 |

FOREIGN PATENT DOCUMENTS

| | | |
|---|---|---|
| 1 157 767 | 2/1968 | (GB) . |
| 1 210 058 | 3/1969 | (GB) . |

* cited by examiner

*Primary Examiner*—Teresa Walberg
*Assistant Examiner*—Vinod Patel
(74) *Attorney, Agent, or Firm*—Andrus, Sceales, Starke & Sawall

(57) ABSTRACT

A pump assembly having a pump with an inlet duct and an outlet duct, the inlet duct including an air separation chamber, which is communicable with a vent of an ejector head in which is provided a venturi to suck air from the air separation chamber and eject it to atmosphere, the ejector head also having a valve member for controlling communication of the vent to atmosphere. A valve member controls communication between the air separation chamber and the ejector head, and the valve members are carried on a common shaft of a float valve assembly which also includes a float carried by said shaft in the air separation chamber, the valve assembly operating so that air in the air separation chamber is sucked into said ejector head and ejected to atmosphere to prime or re-prime the pump, whilst liquid in the air separation chamber is prevented from entering the ejector head.

15 Claims, 2 Drawing Sheets

Figure 1:
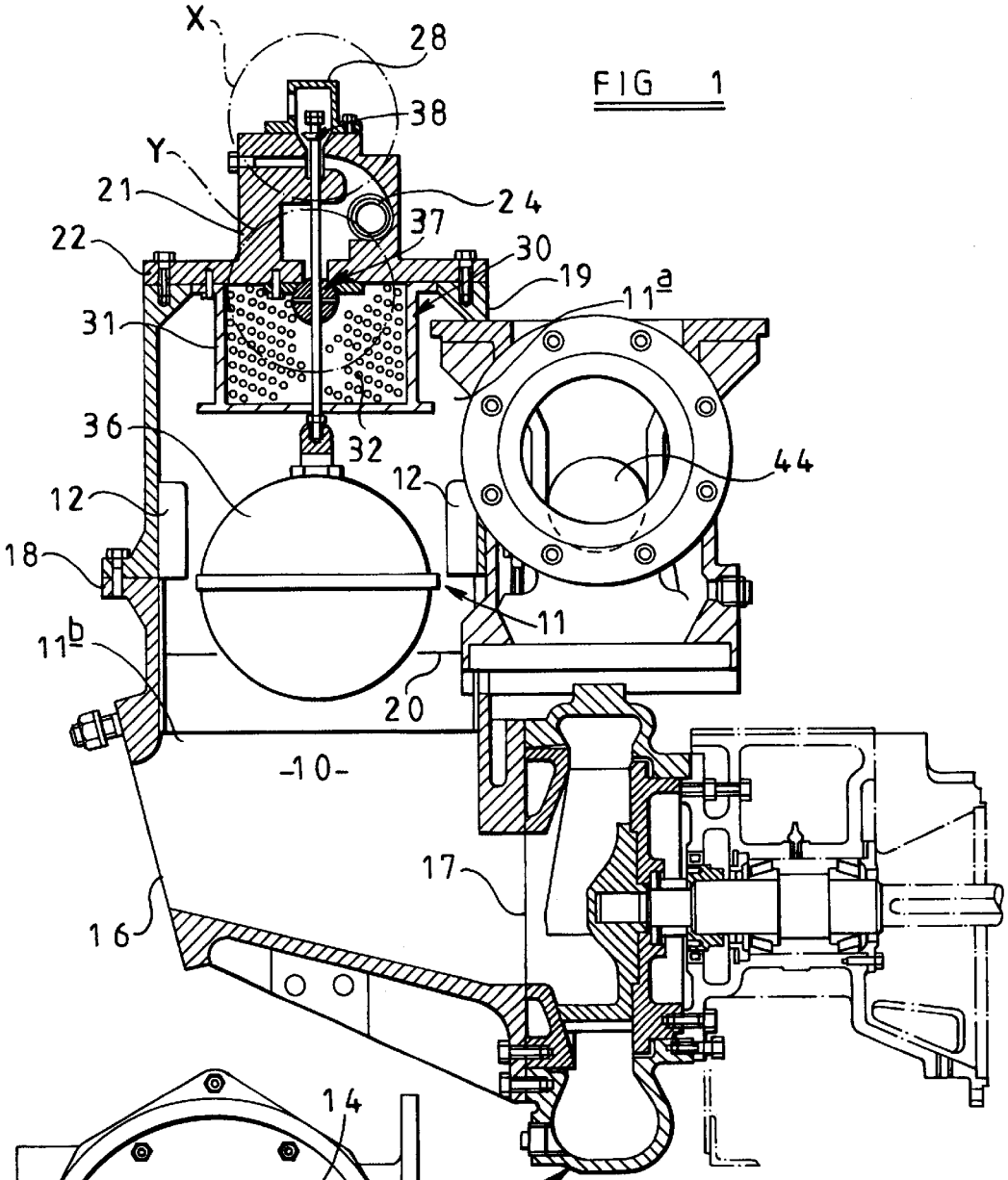

FIG 3
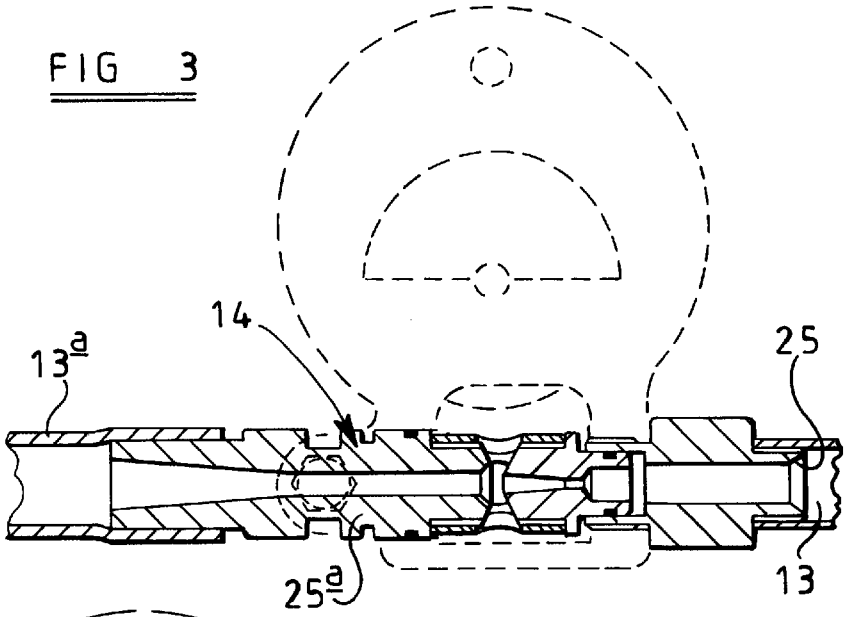
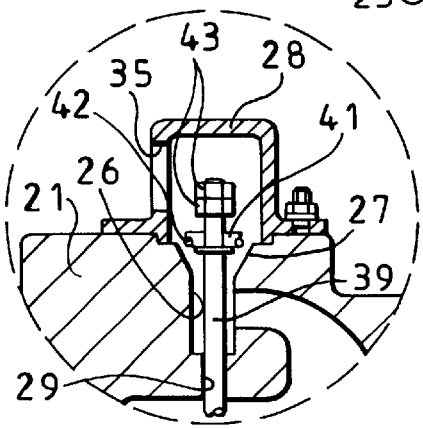
FIG 4
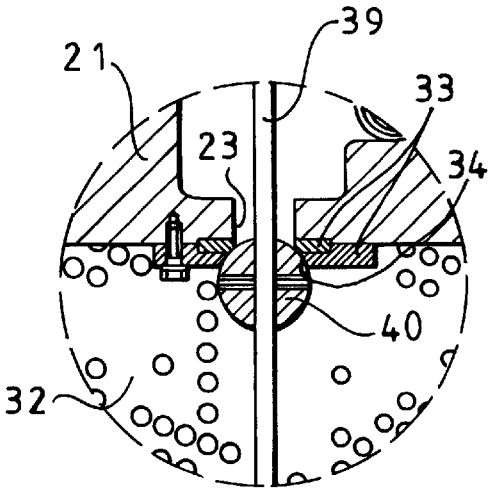
FIG 5
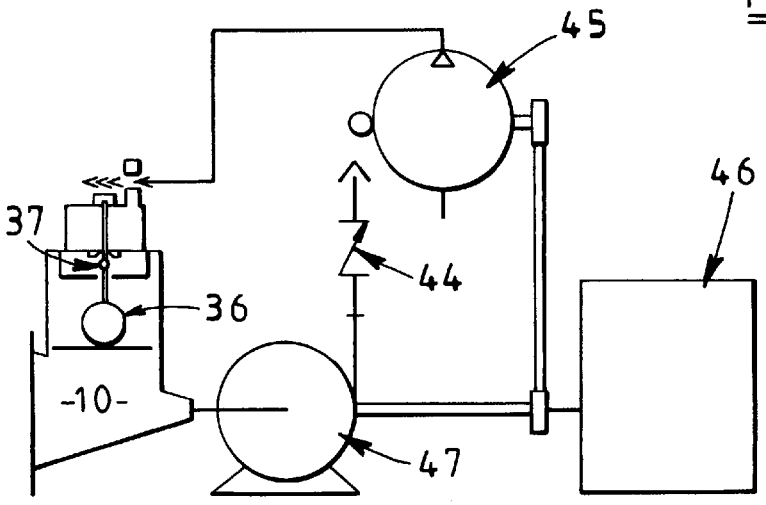
FIG 6

PUMP WITH IMPROVED PRIMING

This invention relates to pumps, particularly the priming thereof, and represents an improvement to the pump described and shown in U.K. Patent No. 1,157,767.

In the embodiment described in that patent specification, the pump has an inlet duct having a chamber immediately upstream of an impeller. A port in an upper wall of the chamber leads to a vent passage for the withdrawal of air from said chamber. The vent passage, which has a venturi section, extends between the inlet duct chamber and a further chamber, a top wall of which has a vent port for the escape of air from the vent passage. The further chamber also has a liquid port communicating with the inlet duct, for returning to the inlet duct any liquid which reaches the further chamber. A float is disposed in said further chamber to control flow through the liquid port.

Compressed air is forced through the venturi section, and as a result of the suction caused by such action, air in the inlet duct will be entrained through the vent passage. This will continue until the inlet end of the inlet duct is surrounded by liquid, whereupon the liquid will be sucked up the inlet duct into said inlet duct chamber and then will fall into the inlet of the pump impeller.

When all the air has been removed from the inlet duct, some liquid will pass through the vent passage and into said further chamber. When a sufficient volume of liquid has accumulated in the further chamber, the float will rise and will permit the liquid which has been drawn through the vent passage to be returned to the inlet duct.

This float is simply operated on an on-off basis in an attempt to isolate the compressed air operated ejector from the pumped liquid, once priming has been achieved. It takes no account of how the arrangement would operate on a continuous dynamic pumping operation where a pumping machine could be regularly handling air/water mixture due to a regular re-priming demand (or 'snore' condition). The above mentioned patent specification merely addresses the initial prime and isolation cycle.

An object of the present invention is to provide a pump assembly which takes account of the abovementioned continuous dynamic pumping operation.

According to the invention there is provided a pump assembly comprising a pump having an inlet duct and an outlet duct between which liquid may be pumped, a vent communicable with the inlet duct and to which air may be drawn from the inlet duct, a non-return valve in the outlet duct to prevent air from being drawn therethrough in a direction towards the pump, means for passing air under pressure through the vent so as to cause air from the inlet duct to be entrained therewith whereby to effect withdrawal of air from the inlet duct and consequent priming or re-priming of the pump, and valve means which operate to prevent liquid entering said vent, the arrangement being such that once the pump is primed or re-primed said vent is communicated to an increased pressure, and remains so until air is again to be withdrawn from the inlet duct, whereupon the valve means operate again to allow passage of air to the vent from the inlet duct and to return said vent to negative pressure, so that air from said inlet duct is again caused to be entrained with said air under pressure to re-prime the pump, such automatic re-priming occurring repeatedly as required.

As referred to herein 'air' includes any gas (or mixture thereof and is not to be considered limited to atmosphere. Also as referred to herein, the air from the 'inlet duct' may simply be air initially drawn into the inlet duct from outside the pump, air from within the pump, or may be air extracted from liquid in which it was suspended, or any combination thereof. 'Primed' refers to the state reached when the priming process is complete, i.e. when pumping of liquid is taking place without withdrawl of air from the inlet duct.

Preferably the valve means includes a buoyancy member, and is, for example, a float valve assembly. Desirably the inlet duct has an inlet chamber and said vent is in the form of an ejector head communicable with said inlet chamber. Conveniently the ejector head receives said air under pressure which entrains said air from the inlet duct, via said inlet chamber. Advantageously said float valve assembly has a float within said inlet chamber, the float being on a shaft which extends into the ejector head and carries a first valve member, engageable with a valve seat between the inlet chamber and the ejector head, and a second valve member engageable with a valve seat between the ejector head and a source of said increased pressure, for example atmosphere.

Figure 2:
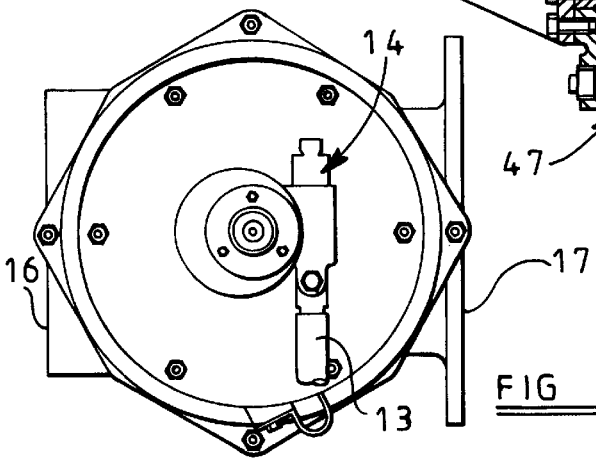

The invention will now be described, by way of example, with reference to the accompanying drawings, in which:

FIG. 1 is a vertical, part-sectional view through a pump assembly of the present invention, FIG. 2 is a general top-plan view of part of the pump assembly shown in FIG. 1, FIG. 3 is a detailed cross-sectional view, to an enlarged scale, of a component shown in FIG. 2, FIGS. 4 and 5 are enlarged views of the areas shown marked X and Y respectively in FIG. 1, and FIG. 6 is a diagrammatic view of said pump assembly of the invention.

As mentioned above, this invention relates to an improvement in the pump shown in prior British Patent specification No. 1,157,767, and particularly concerns the prevention of any liquid leakage/carry over through the air ejector assembly, so that not only does pumped liquid residue not enter the ejector assembly, thereby eliminating contamination and/or blockage of the fundamental parts of the air ejector priming system, but additionally the elimination of such leakage confirms the device as environmentally friendly, with no toxic or unfriendly materials being released into the environment.

A pump of the present invention basically operates in the same manner as the pump of the earlier patent, and accordingly these common operating component parts are not described in the present application. Thus the pump of the present invention may be a centrifugal pump having either an open, semi-enclosed or fully shrouded type of impeller which is adapted to pump a liquid from an inlet duct to an outlet duct. With the pump shown in FIG. 1, an inlet duct 10 is identified. The inlet duct 10 includes an air separation chamber 11 which, as will be explained, can be considered to be made up of upper and lower portions, 11*a*, 11*b* respectively. A series of baffles 12 are provided to neutralise the volatile water/air interface present in use, so as to break up the water, rotated by the impeller, and allow the air suspended in the water to be extracted, as will be described.

The chamber 11 is disposed upstream of the impeller, while the outlet duct is provided with a non-return valve 44 therein which will open to permit liquid to be pumped out through the outlet duct, but will prevent reverse flow therethrough.

As with the prior art pump assembly, an air compressor, which draws in air through an inlet duct, forces the air which it compresses through a pipe. In FIG. 3 of this application, this pipe is shown at 13, having connected at its end a compressed air ejector assembly 14 which is, in effect, equivalent to the vent passage and venturi section of the pump assembly shown in the prior art patent specification.

The air compressor is driven by a belt drive extending from an extension shaft of a prime mover whose main shaft drives the impeller. As previously, the prime mover may, for example, be an electric motor or an internal combustion engine. Again the main shaft may be provided with a shaft seal or gland which will operate in either the wet or dry condition, i.e either whether the pump is pumping liquid or not. Again, if desired, the compressed air supplied to the pipe 13, instead of being delivered from a compressor driven by a prime mover, could be delivered from another source such as an independent compressor. Moreover the pipe 13 could alternatively be supplied with any compressed gas (from a source not shown).

The major area of difference between a pump assembly of this application and that of the earlier patent relates to the isolation of the air ejector assembly and the vent port through which air from the inlet duct is diffused to atmosphere, from liquid in the air separation chamber 11. Accordingly the structure shown in FIGS. 1 and 2 effectively replaces the inlet duct chamber, the vent passage and the chamber having the vent port and liquid port therein.

As shown in FIG. 1, the lower part of this replacement structure is formed as a casting or the like, constituting said inlet duct 10 with an inlet opening 16 and an outlet opening 17. The duct is extended cylindrically upwardly to define a horizontal outer peripheral end flange 18 to which is bolted a lower peripheral flange of an upper hollow cylindrical component 19, which is open at both of its ends. However at its end adjacent the cylindrical upper part of the inlet duct, this component 19 is provided with said baffles 12 around its inner surface. Additionally similarly operating baffles 20 can be provided around the internal surface of the upper cylindrical part of the inlet duct. The interior of said upper cylindrical part of the inlet duct constitutes said lower portion 11*b* of the air separation chamber 11, whilst at least the interior part of the component 19 provided with the baffles 12 constitutes the upper portion 11*a* of said chamber 11.

The upper end of the component 19 is closed by a component, for example in the form of a casting, defining an ejector head 21, a lower horizontal annular flange 22 of the ejector head 21 being bolted to the upper part of the component 19 as shown, this flange having a central circular through opening 23 which is co-axial with the central axis respectively of both the in let duct and the component 19.

This ejector head 21 is formed with a passage/chamber extending upwardly from the opening 23, and extending through the ejector head 21 at one side of this passage is part 24 of the air ejector assembly 14. The assembly further includes an ejector jet element 25 and a venturi 25*a*. Compressed air is fed to element 25, expanded and passed at extreme high velocity across the interconnection gap between element 25 and venturi 25*a*. The high velocity air impinges on the static air around the assembly 14, causing the static air to be entrained. The mixed air then exits to atmosphere through outlet pipe 13*a*. This arrangement is such that, as will be described in detail hereinafter, air from the inlet duct can, in some circumstances, enter the ejector head chamber and be entrained with the pressurised air as a result of the venturi action, so that in the same way as with the original pump assembly of the earlier patent the entrained air is diffused to atmosphere, the air extraction leading to priming of the pump. Thus in effect the air ejector chamber constitutes a vent for diffusion of said air from the inlet duct, even though final diffusion of the air is at an outlet which, in the illustrated embodiment, is actually external to the ejector head chamber.

As shown best in FIG. 4, the ejector head chamber terminates at the upper part of the ejector head by braking generally radially into a vertical, circular section passage 26 which is co-axial with the opening 23 and which opens upwardly to form an outwardly tapered valve seat 27 at the external surface of the top part of the ejector head 21. Surrounding this valve seat 27 is a hollow cylindrical cap 28 which is bolted to the top of the ejector head 21. The innermost part of the passage 26 is stepped to form a reduced diameter guide bore 29 for a purpose to be described hereinafter.

To the centre of the internal surface of the flange 22 is bolted a cylindrical, generally circumferentially open structure 30 which comprises three vertical, angularly spaced cast pillars supporting a base, on which is carried a cylindrical mesh filter 32. The structure 30 is arranged co-axial with the opening 23, and around the lower surface of this opening are bolted plates 33 which define a downwardly facing, outwardly tapered valve seat 34.

As can thus be appreciated, the passage/chamber within the ejector head 21 can communicate with both the air separation chamber 11 through the opening 23 and with atmosphere through the opening defined at the valve seat 27, the cap 28 having an opening 35 in a side wall thereof to provide said communication to atmosphere. However the arrangement is such that at any given time this passage/chamber in the ejector head 21 can only be in communication with either the air separation chamber 11 or atmosphere, but not both simultaneously. Its communication is controlled by valve means comprising a spherical float 36 and two in-line valve elements 37, 38 respectively, these elements being carried on a straight vertical rod 39 extending upwardly from the float 36, as shown in FIG. 1. The float is disposed centrally within the air separation chamber 11, and responds to the rise and fall of liquid level in this chamber which occurs during the dynamic operation of the system. FIG. 1 shows the float in its uppermost position. In the ejector head passage/chamber, the rod extends through the bore 29, which serves to guide sliding of the rod.

The valve element 37 is in the form of a ball 40 (FIG. 5) fixed to the rod 39 which extends centrally therethrough. As can be seen from FIG. 1, the uppermost position of the float causes this ball 40 sealingly to engage the valve seat 34 so as to prevent communication between the air separation chamber 11 and the passage/chamber within the ejector head 21. Adjacent the upper end of the rod, as shown best in FIG. 4, is the valve element 38 which is in the form of an annulus 41 with its periphery tapered downwardly and inwardly and receiving in a groove therein an 0-ring seal 42, the valve element 38 being sized so as to be a sealing fit with the valve seat 27 when, in this example, the float 36 is in any position within the air separation chamber other than its uppermost one. The rod 39 extends centrally through the annulus 41, with the element 38 being slidable on said rod 39. To the upper end of the rod are screwed a pair of nuts 43, these acting as an end stop, acting to force the valve member 38 down on to its seat 27 when the float moves downwardly, the engagement of the valve element 38 on its seat in such an embodiment corresponding to the lowermost position of the float. The rod 39 is provided with pins or other projections (such as nuts 43) appropriately axially spaced at respective opposite sides of the annulus 41 to control movement of this annulus relative to the vertical up and down movement of the rod 39. For example a pin could be arranged on the rod at a position below the annulus to ensure that when the float, and thus the rod, moves vertically upwardly, the pin engages the annulus to move it off its seat, this occurring, as will be explained, simultaneously with, or just after, the engagement of the ball 40 onto its seat 34. FIG. 4 shows a type of circlip underneath the annulus 41, which circlip controls the position where the valve element opens. Similarly a pin on the rod between the annulus and the nuts 43 would force the annulus down onto its seat when the rod moves downwardly to any degree, in response to corresponding downwards movement of the float due to a fall in liquid level in the air separation chamber. If necessary or desirable, it could be arranged that the ball 40 is also slidable on the rod 39, with its movement, and thus its engagement on its valve seat relative to the movement of the float being controlled by similar pins or the like on the rod. When the air separation chamber is isolated from the passage/chamber in the ejector head 21, said passage/chamber is in communication with atmosphere (or other source of pressure greater than that in chamber 11 to try to force the float downwardly) through the valve seat 27 and opening 35 in cap 28. Alternatively when the air separation chamber 11 is in communication with the passage/chamber in the ejector head 21 through the valve seat 34, the passage/chamber is isolated from communication with atmosphere (or said other pressure source) via opening 35, by virtue of the valve element 38 engaging onto its valve seat 27.

Accordingly a direct acting pressure equilibrium/equalising valve is provided in the ejector head assembly, this being directly actuated by a vertically operated in-line float. As stated, the function of the float is to respond to the rise and fall of liquid level in the air separation chambers 11*a*, 11*b*.

FIG. 6 diagrammatically shows the pump assembly, and in particular the non-return valve 44 in the pump outlet line, the air compressor, denoted by numeral 45, which is driven by an engine/motor 46, and pump 47 of the pump assembly.

In operation, the air compressor forces compressed air along pipe 13 and through the assembly 14. Accordingly if at this time the inlet opening 16 is temporarily exposed to the atmosphere (e.g. float 36 in its lower position), the ejector effect will cause air in the inlet duct to pass through the lower portion 11*b*, the upper portion 11*a*, the mesh filter 32 and the opening 23 into the passage/chamber in the ejector head 21, so as to be entrained with the air of the air ejector assembly 14. It will be appreciated that in the state of the pump described, there being no liquid in the air separation chamber portions, the float would be in its said lowermost position so that the opening 23 is open, whilst the valve element 38 sealingly engages onto its valve seat 27. Accordingly there is a negative pressure in the passage/chamber in the ejector head 21 resulting, as described, in air being 'sucked' from the sub-atmospheric inlet duct as described. This suction will close the non-return valve at the outlet duct of the pump and will thus prevent air in the outlet duct from being withdrawn therefrom and being forced in a reverse direction through the impeller.

The withdrawal of the air from the inlet duct will cause liquid to be sucked into the inlet duct as soon as the inlet end or inlet opening 16 is surrounded by liquid. This liquid will then pass into the inlet duct from where it will pass into the inlet of the (centrifugal) pump impeller structure. However the operation of the valve means is such that as soon as liquid begins to be drawn into the inlet duct, the float 36 will rise so that the ball 40 will engage on its seat 34 thereby closing communication between the air separation chamber 11 and the passage/chamber within the ejector head 21. Thus in contrast with the arrangement of the pump assembly of the earlier patent, the pumped liquid residue does not ever enter the ejector assembly space, thereby eliminating contamination and/or blockage of the fundamental parts of the air ejector priming system. Moreover there is no liquid leakage/carryover through the air ejector assembly to atmosphere, so that the device is environmentally friendly. With the pump assembly described in the earlier patent, the residue is recycled back through the liquid port via the vent passage, the port connecting it to the inlet chamber, and the venturi section.

The valve means is such that the float 36, non-return ball valve 40 and equilibrium/equalising valve 38 operate from the basic movement of the float all on a common axis. As described, the valve element 38 is engaged on its seat 27 whilst air is sucked from the inlet duct 15 to be entrained with a pressurised air at the air ejector assembly 14. However as soon as the ball 40 engages on its seat 34, the structure of the valve means is such that the valve element 38 is simultaneously, or almost simultaneously thereafter, lifted so as to move to the position shown in FIGS. 1 and 4, although as it is slidable thereon, the element lags behind the upward movement of the rod 39. Thus the passage/chamber in the ejector head 21 is now isolated from the air separation chamber 11, but is communicated to atmosphere (or other increased pressure source greater than the pressure in chamber 11) through the valve seat 27 and cap opening 35. The size of this inlet path is such as to permit quantities of air to enter the ejector head which are in excess of the potential air handling ability of the head, i.e. a larger throughput capacity than the air ejector assembly, so that the ejector head pressure is brought to atmospheric. When the liquid to be pumped fills the pump body, or is at least sufficient to seat ball 40, the pump will maintain its condition of prime and will create a pressure on its delivery side. The non-return valve will then be open and permit the liquid to be pumped out through the outlet duct. Accordingly whilst pumping continues, the float will be maintained in its uppermost position as shown in FIG. 1. This is because although as soon as the greater pressure is created in the chamber of the ejector head, such pressure acts to try to force the ball 40 downwardly, the ball remains seated, with the pump fully primed and pumping, due to the buoyancy of the float in the liquid.

The pressure in the ejector head chamber increases only when the pump is primed, the ball 40 being seated. When the cycle of the priming process commences, the float 36 and ball 40 will be in their respective lower positions. In a real pumping condition, the pump will attempt to operate as a pumping machine as soon as the lower part of inlet duct is covered with liquid. It may be that this does not exactly coincide with the float 36 being raised sufficiently to seat the ball 40. The priming process will continue to evacuate air until the ball seats, whereupon the pump is primed.

However if the ball 40 is forced downwards, due a dropping of the liquid level due to entrainment, and/or to a reduced (insufficent) amount of incoming liquid being in the chamber 11 (being supplied to the pump) and/ or due to pumping being complete, the valve element 38 will be moved onto its seat 27 as the rod 39 moves vertically downwardly with the float 36. Accordingly a negative pressure is restored in the passage/chamber in the ejector head 21, as this is no longer in communication with the greater pressure, i.e. atmosphere, due to the closing of the valve formed by its seat 27 and element 38. Thus once more air from the inlet opening 16 and/or liquid in chamber 11 will be drawn upwards through the air separation chamber portions 11*a*, 11*b* into the ejector head passage/chamber, where it is entrained with the air under pressure delivered by the ejector assembly 14, and diffused to atmosphere through outlet pipe 13*a*. The priming/re-priming operation described will repeat as appropriate during use of the pump so that there is a continuous cycle of reliable isolation of the compressed air ejector priming system from liquid carryover.

The filter 32 is merely provided as protection should any floating debris ever reach the upper part of the portion 11*b*. Without this filter, such debris might inhibit the effectiveness of the valve element 37 at its seat 34. It is of course the case that this valve must always close before any liquid could reach the ejector head 21.

As mentioned, when the liquid being pumped is water, the volatile water/air interface is neutralised by the baffles 12 and 20. It may be that in practice it will be important that effective air/water separation occurs so as to prevent air being circulated back into the pump. The arrangement described is particularly effective in that the float valve, non-return valve, and equilibrium valve operate, as stated, from the basic movement of the float, all on a common axis. This enables there to be an equalising of the pressures to allow the float automatically to operate repeatedly after the initial prime. Accordingly a single directional operating valve assembly including a pressure equalising system is provided to ensure repeated reliable isolation of the compressed air ejector priming system. There is no reliance on intentionally venting air back into the pump to maintain the control of liquid carryover. As stated, the device effectively eliminates any potential static or dynamic situation that would occur where leakage/carryover of the liquid through the air ejector assembly is possible. Accordingly, as also previously mentioned, the device is thus environmentally friendly. As a consequence of the prevention of intentional air leakage into the pumping system, no deterioration of the primary pumping performance occurs. The valve arrangement used is particularly simple and involves no leverage.

Accordingly whilst a centrifugal pump cannot handle large amounts of air suspended in a liquid, and will generally cease pumping as a result, the air separation system and independent air handling system of the pump of the invention allows normal pump operation to be carried out.

What is claimed is:

1. A pump assembly comprising a pump having an inlet duct and an outlet duct between which liquid may be pumped, a vent communicable with the inlet duct and to which air may be drawn from the inlet duct, a non-return valve in the outlet duct to prevent air from being drawn therethrough in a direction towards the pump, means for passing air under pressure through the vent so as to cause air from the inlet duct to be entrained therewith whereby to effect withdrawal of air from the inlet duct and consequent priming or re-priming of the pump, and valve means which operate to prevent liquid entering said vent, the arrangement being such that once the pump is primed or re-primed said vent is communicated to an increased pressure, and remains so until air is again to be withdrawn from the inlet duct, whereupon the valve means operate again to allow passage of air to the vent from the inlet duct and to return said vent to negative pressure, so that air from said inlet duct is again caused to be entrained with said air under pressure to re-prime the pump, such automatic re-priming occurring repeatedly as required.

2. A pump assembly as claimed in claim 1, wherein the valve means include a buoyancy member.

3. A pump assembly as claimed in claim 2, wherein the valve means is a float valve assembly.

4. A pump assembly as claimed in claim 3, wherein the inlet duct has an inlet chamber and said vent is in the form of an ejector head communicable with said inlet chamber.

5. A pump assembly as claimed in claim 4, wherein said float valve assembly comprises a float within said inlet chamber, a first valve member engagable with a valve seat between the inlet chamber and the ejector head, and a second valve member engagable with a valve seat between the ejector head and a source of said increased pressure.

6. A pump assembly as claimed in claim 4, wherein the inlet chamber has baffle means.

7. A pump assembly as claimed in claim 5, wherein said source of increased pressure is atmosphere.

8. A pump assembly as claimed in claim 7, wherein the means for passing air under pressure through the vent is an air ejector assembly comprising a venturi within the ejector head so as to cause said air from the inlet duct to be entrained therewith.

9. A pump assembly as claimed in claim 8, wherein the size of an inlet path communicating said atmospheric pressure to said ejector head provides a larger throughput capacity than the air ejector assembly, so that, in use, the ejector head pressure is brought to atmospheric.

10. A pump assembly as claimed in claim 5, wherein said float, said first valve member, and said second valve member are on a common shaft which extends from said inlet chamber into said ejector head.

11. A pump assembly as claimed in claim 10, wherein said second valve member is slidable relative to said shaft.

12. A pump assembly as claimed in claim 11, wherein movement of said second valve member on to or off its valve seat respectively is controlled by engagement means on the shaft at respective opposite sides of the second valve member.

13. A pump assembly as claimed in claim 10, wherein the first valve member is fixed to said shaft.

14. A pump assembly as claimed in claim 5, wherein the first valve member is a ball.

15. A pump assembly as claimed in claim 5, wherein a particle filter is provided between said inlet chamber and said valve seat of the first valve member.

* * * * *